United States Patent [19]

Hertel

[11] 4,446,667

[45] May 8, 1984

[54] DAMPER FRAME CONSTRUCTION

[75] Inventor: Robert C. Hertel, Grandview, Mo.

[73] Assignee: Ruskin Manufacturing Company, Grandview, Mo.

[21] Appl. No.: 387,966

[22] Filed: Jun. 14, 1982

[51] Int. Cl.[3] ..... E04C 2/38

[52] U.S. Cl. ..... 52/658

[58] Field of Search ..... 52/656, 658, 211, 215, 52/475, 204, 205, 206; 49/504, 380, 506; 403/403

[56] References Cited

U.S. PATENT DOCUMENTS

| | | | |
|---|---|---|---|
| 2,219,594 | 10/1940 | Lang | 52/658 X |
| 2,241,266 | 5/1941 | Mayne et al. | 52/658 |
| 2,952,342 | 9/1960 | Schnittker | 52/658 |
| 3,348,353 | 10/1967 | Cartagena | 52/658 |
| 3,854,248 | 12/1974 | Dayus | 52/658 X |

*Primary Examiner*—Alfred C. Perham

*Attorney, Agent, or Firm*—Kokjer, Kircher, Bradley, Wharton, Bowman & Johnson

[57] ABSTRACT

A one-piece damper frame wherein transverse slots in a channel shaped longitudinal frame member permit the frame sections to be bent to define a frame opening and flanges integral with the channel are unsevered to provide continuous integrity throughout the frame perimeter. Tabs formed in the frame material by extensions of the transverse slots overlap the proximal frame section across the corner and are secured in a manner to rigidly hold the corners in their appropriate angled positions.

5 Claims, 18 Drawing Figures

DAMPER FRAME CONSTRUCTION

This invention relates to air handling devices, and more particularly to a novel frame construction for dampers, louvers or the like.

Air handling devices of the type contemplated by this invention are commonly utilized in buildings and other structures to control the flow of air, smoke or other substances through a particular section of the building. For example, building codes often specify that dampers of this general type shall be interposed in the heating and air conditioning ducting at certain locations to prevent the spread of smoke and combustion air through a building in case of fire. Other dampers may be utilized to adjust air flow to maintain certain ambient temperatures or to provide a given amount of ventilation for a particular structure.

Devices of this type must be of sufficiently rugged construction to remain in good working condition over relatively long periods of time with little or no operator attention. They often must be installed in remote or out of the way locations in the building where they are relatively inaccessible for periodic inspection, maintenance or operator attention. Frequently, they may become exposed in such locations to deleterious atmospheric or other conditions, yet it is very important that they remain in good working condition throughout the period of installation.

The large number of such devices which may be required for properly controlling or protecting a single building for example, dictates that the cost of such units be kept as low as possible. It has been found that devices fabricated largely or entirely from relatively thin gauge, galvanized sheet steel are capable of providing the length of service life which is required for most installations. Such material is subject to high speed fabricating techniques involving roll forming, bending and punching operations. This contributes greatly to holding the costs for such units to a minimum.

One disadvantage heretofore noted with such sheet metal construction for devices of this type has been the difficulty encountered in fabricating a suitable frame. These devices typically have a peripheral frame defining the damper opening, and blades are pivotally mounted on this frame for controlling or blocking flow through this opening as required for existing conditions. An elongated frame member is roll formed to the required cross-sectional configuration and the member is then cut into sections of whatever lengths are needed to fabricate a damper of the size specified by the customer. Various means have been employed for joining the sections at the corners, but until now they have been deficient in that they are too expensive or are not reliable for use over extended periods of time, or may suffer from both of these disadvantages.

The trouble-free life expected from units of this type requires that the frame be substantially immune from any tendency to develop loose corner joints between the frame sections. If the corner joints become loosened, the air flow through the damper is likely to develop objectionable rattle or "chatter" from the unit. Vibration of this type not only may permit sufficient misalignment of components as to render the device unreliable for operation, but it may also result in enough wear to require that the unit be replaced. Such replacement is often difficult to accomplish and may require substantial dismantling of the structure for access to the unit.

Accordingly, it is a primary object of this invention to provide a novel frame construction for dampers of this type wherein the completed damper frame is of enhanced durability capable of relatively long, trouble-free service.

Another important object of the present invention is to provide a damper frame whch is one piece construction so that the structural integrity of the frame member is retained to the maximum extent possible for militating against the loosening of the corner joints.

Still a further object of the present invention is to provide a frame construction which achieves maximum durability for long periods of trouble-free service yet which retains all of the economies available from sheet metal fabrication utilizing high speed production techniques.

A further object of the invention is to provide a frame construction which utilizes a high speed, low cost punching operation to make the required cuts in the frame member to permit the required bending at the frame corners to define the final frame shape, which punching operation also forms tabs in the frame material suitable for utilizing this material to rigidly secure the frame sections in their appropriate angled positions.

These and other important aims and objectives of the present invention will be further explained or will become apparent from the following description and explanation of the drawings, wherein.

Figure 15:
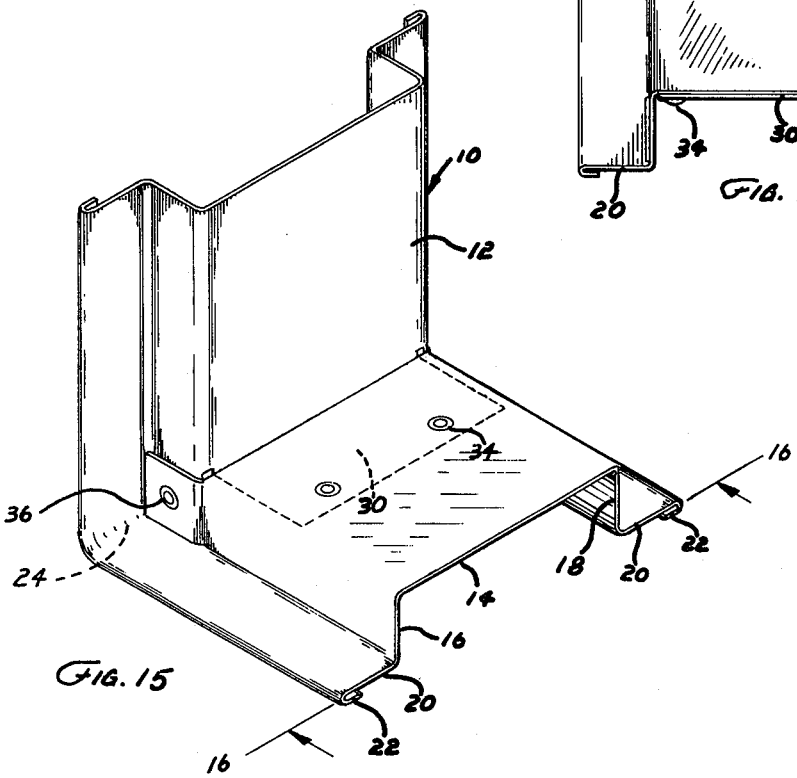
FIG. 15 is a view similar to FIG. 13, but illustrating a frame corner fabricated with the form of the invention illustrated in FIGS. 7 and 8.

Referring initially to FIGS. 7, 8 and 15 through 17 of the drawing, the currently preferred form of the invention comprises a frame 10 formed from an elongated initially flat sheet member 12 bent into a longitudinally extending generally inverted U shaped channel having a bight portion 14 and a pair of integral spaced apart leg portions 16 and 18 projecting from the bight portion as shown clearly in FIG. 15. Each leg portion has an integral flange 20 projecting outwardly from its corresponding leg portion at a right angle therefrom. The outermost marginal edge 22 of each flange 20 is bent back upon the flange in a manner to provide enhanced rigidity for the flange.

The construction thus far described is such that it may be readily carried out by means of high speed roll forming techniques capable of imparting the described channel configuration to the initially flat sheet member material so that relatively long lengths of channel material are provided. The next step in the construction of a damper frame embodying the principals of this invention involves the cutting or severing of a portion of the channel member at the location where each frame corner is desired. To this end, member 17 is partially severed to provide a transversely extending slot 24 which completely severs the bight portion 14 and the leg portions 16 and 18 in the manner illustrated in FIGS. 7 and 8 of the drawing. The transverse notches 24 are, of course, spaced apart longitudinally along the channel member at distances corresponding to the appropriate lengths for the corresponding frame sections. Slots 24 are not extended through the outwardly extending flanges 20 at the three intermediate corner locations for a given frame but the notch 26 corresponding to the fourth or terminal corner location extends completely through the channel member including the flanges 20 and edges 22 to sever the member at this location. This slot for the member completely severing the latter defines the peripheral length of a single damper frame. Obviously, the steps heretofore described are repeated sequentially along the length of the entire channel member so that a plurality of damper frames may be severed from a single member.

Figure 1:
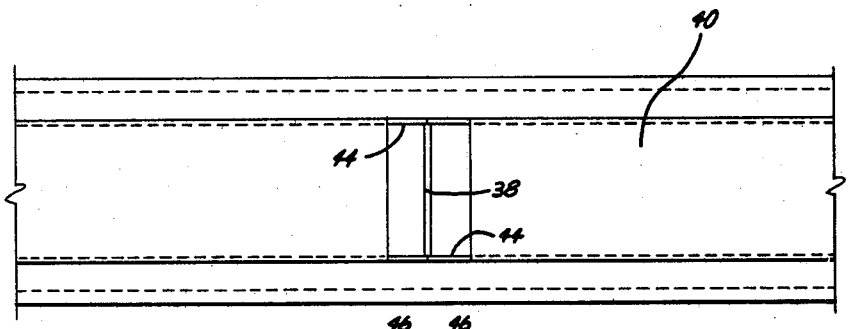
FIG. 1 is a fragmentary, top plan view of a frame member illustrating the cuts in the member for forming a frame corner joint pursuant to one embodiment of the present invention, some hidden edges of the member material appearing in phantom for clarity.
Figure 2:
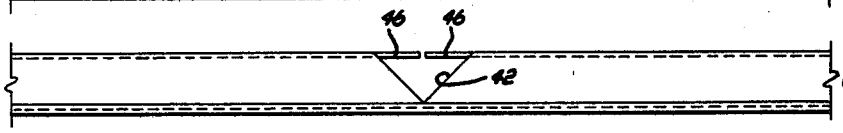
FIG. 2 is a fragmentary, side elevational view of the member of FIG. 1.
Figure 3:
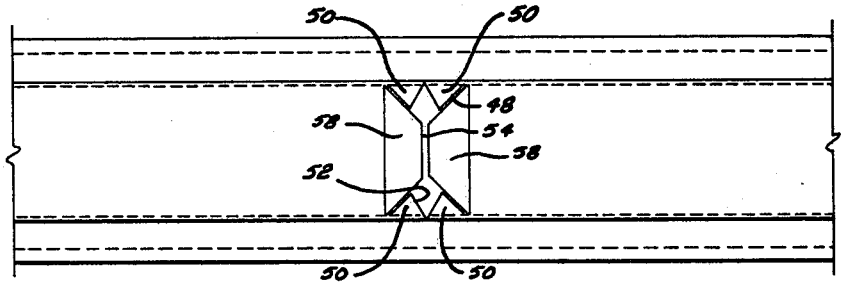
FIG. 3 is a view similar to FIG. 1, but illustrating a modified form of the invention.
Figure 4:
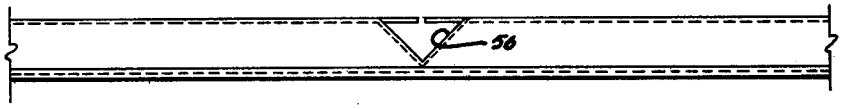
FIG. 4 is a fragmentary, side elevational view of member of FIG. 3.
Figure 5:
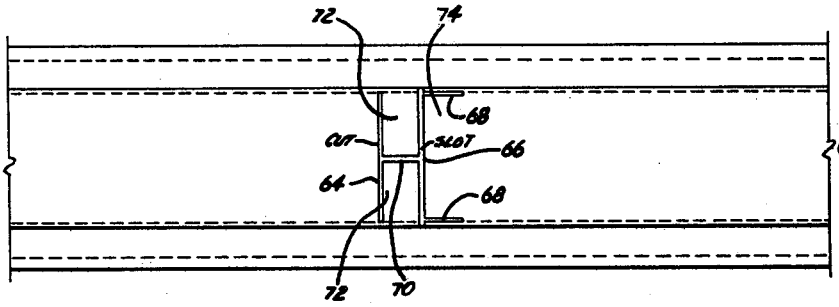
FIG. 5 is a view similar to FIG. 1, but illustrating another embodiment of the invention.
Figure 6:
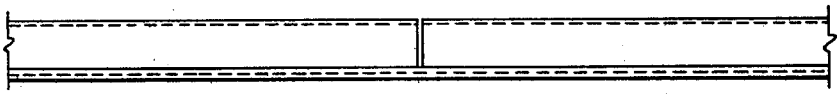
FIG. 6 is a fragmentary, side elevational view of the member of FIG. 5.
Figure 7:
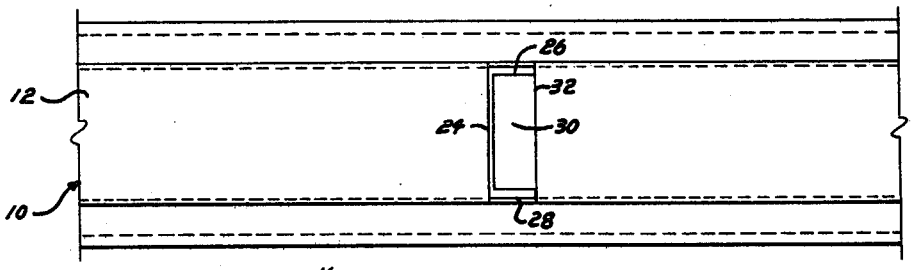
FIG. 7 is a view similar to FIG. 1, but showing still another embodiment of the present invention.
Figure 8:
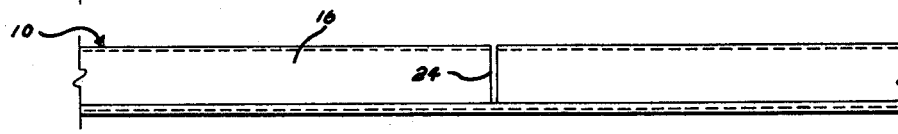
FIG. 8 is a fragmentary, side elevational view of the member of FIG. 7.

In conjunction with the transverse slot 24 at each corner location, a pair of spaced apart notches 26 and 28 extend through the bight portion and project longitudinally of the member adjacent the respective outermost margins of the latter as illustrated best in FIG. 7. The notches 26 and 28 communicate with slot 24 to define a flap 30 of bight portion material integral with the latter but bendable along a line 32 to provide an integral reinforcement for the corner as will be described hereinafter. Each notch 24 for each of the four corners for a frame are provided with corresponding notches 26 and 28 so that all four corners are provided with corresponding flaps 30.

Figure 16:
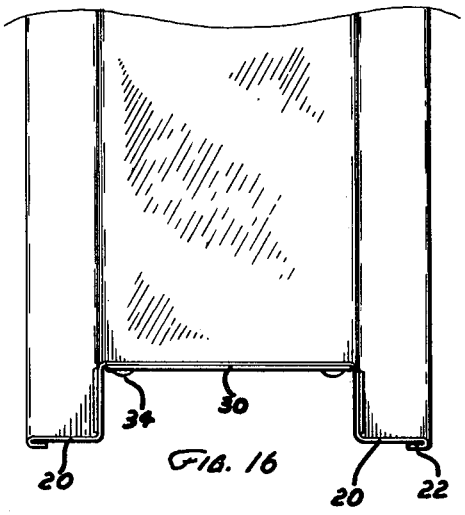
FIG. 16 is a detailed cross-sectional view taken along line 16—16 of FIG. 15.

FIGS. 15 and 16 illustrate best the final construction of a corner pursuant to the principals of this form of the invention. The unsevered material of the outwardly projecting flanges 20 and corresponding edges 22 is bent to dispose adjacent frame sections at right angles at the corner locations. The corresponding flaps or tabs 30 are then bent along line 32 across the notch 24 and into superimposed proximity to the bight portion 14 of the adjacent frame section as illustrated best in FIG. 15. Thus the flap 30 integral with one frame section will be secured to the bight portion of the adjacent frame section by means of rivets 34 or other suitable fastening means to rigidly secure the corners in the position shown. In order to provide space for movement of the bight sections of one frame section in the projecting portions 36 of legs 16 and 18 of the other frame section, such portions 36 may be bent slightly outwardly as illustrated in FIG. 15. In this manner, the channel shape of the adjacent frame section is readily received between the portions 36.

It will be readily understood that the construction heretofore described is repeated at each of the four frame corners, although the flanges 20 are not bent at the terminal or end corner. Rather, the slot 24 (illustrated in dash line in FIG. 15) severing the material eliminates the need for such a bend at this location.

Figure 9:
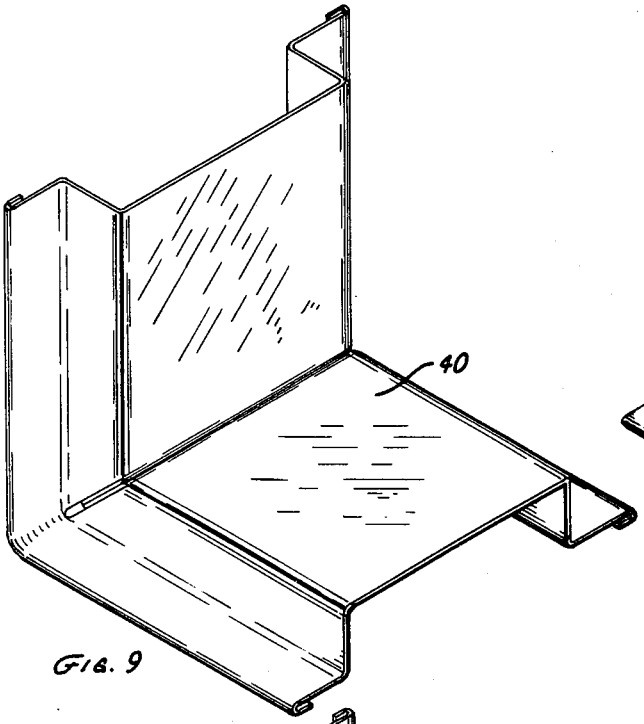
FIG. 9 is a fragmentary, front perspective view of a frame corner constructed with the member illustrated in FIGS. 1 and 2.
Figure 10:
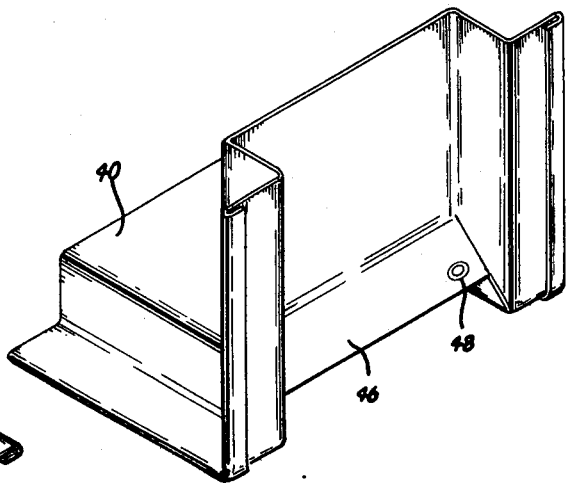
FIG. 10 is a fragmentary, rear perspective view of the corner of FIG. 9.

The general principals heretofore outlined with respect to the presently preferred form of the invention are carried forth in the various modified forms of the invention shown in the remaining figures of the drawing. In the embodiment shown in FIGS. 1 and 2, the transverse notch 38 through the bight portion of the channel member 40 (identical in all respects to member 12) terminates in an enlarged V shaped notch portion 42 extending through each of the channel legs. The longitudinal extending notches 44 adjacent the channel legs are, however, extended in both directions from the transverse notch 38 to present a pair of integral flaps 46 on either side of the transverse notch. The flaps 46 are bent into mutual embracing relationship and fastened together such as with rivets 48 to secure the respective frame sections in their angled positions as illustrated in FIGS. 9 and 10. In all other respects, the embodiment illustrated in FIGS. 1, 2, 9 and 10 are substantially the same as the described with respect to the presently preferred form of the invention.

Figure 11:
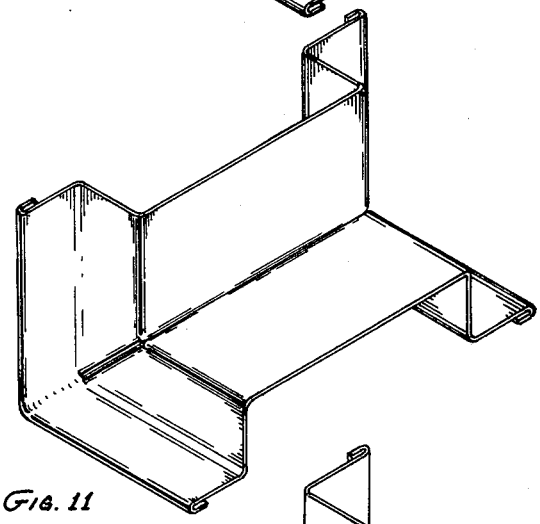
FIG. 11 is a view similar to FIG. 9, but illustrating a frame corner constructed with the embodiment illustrated in FIGS. 3 and 4.
Figure 12:
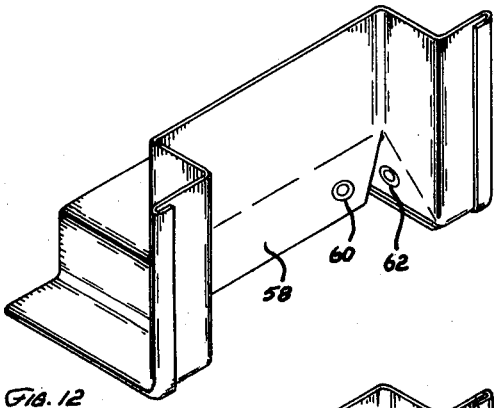
FIG. 12 is a view similar to FIG. 10, but illustrating the corner of FIG. 11.

The construction illustrated in FIGS. 3, 4, 11 and 12 is very similar to the construction described and shown in FIGS. 9 and 10 with the exception that angled cuts 48 are utilized instead of the cuts extending parallel to the edges of the channel member. Such angled cuts as shown best in FIG. 3 result in triangularly shaped tabs. The edges of the bight section are further separated into four identical flaps 50 by a V shaped notch extension 52 formed in a part of the transverse notch 54 as clearly appears in this figure of the drawing. The legs of the channel bight section have notches 56 which are substantially similar to the notches 42 in the FIG. 1 and 2 embodiment. Obviously, the angled cuts 48 result in flaps 58 on either side of the notch 54 and such flaps are bent into embracing relationship and secured together by rivets 60 when the frame sections are bent at right angles to one another as shown in FIGS. 11 and 12. In this case, however, the corresponding pairs of flaps 50 are also bent into embracing relationship and secured together by rivets 62 to provide additional stability to the frame at the corners.

The form of the invention illustrated in FIGS. 5, 6, 13 and 14 of the drawing has many similarities to the other forms of the invention described above. In this case, however, a secondary transverse slot 64 extends in spaced apart parallelism from the primary transverse slot 66. Also, the longitudinally extending slits 68 at each side of the bight section extending parallel to the edges thereof are provided only on one side or primary slot 66. A single slit 70 communicates with slots 66 and 64 intermediate the edges of the bight section of the frame member to thereby provide a pair of flaps 72 cut from the bight section material but remaining integral with the material of the leg sections of the channel member. The spaced apart slits 68 cooperate with the transverse slot 66 to provide a third flap 74 in the material.

Figure 14:
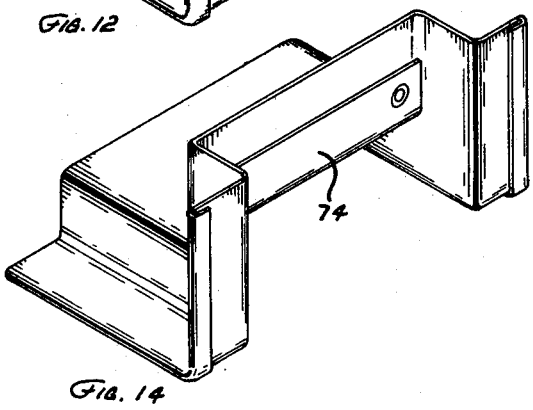
FIG. 14 is a view similar to FIG. 12, but showing the corner of FIG. 13.
Figure 13:
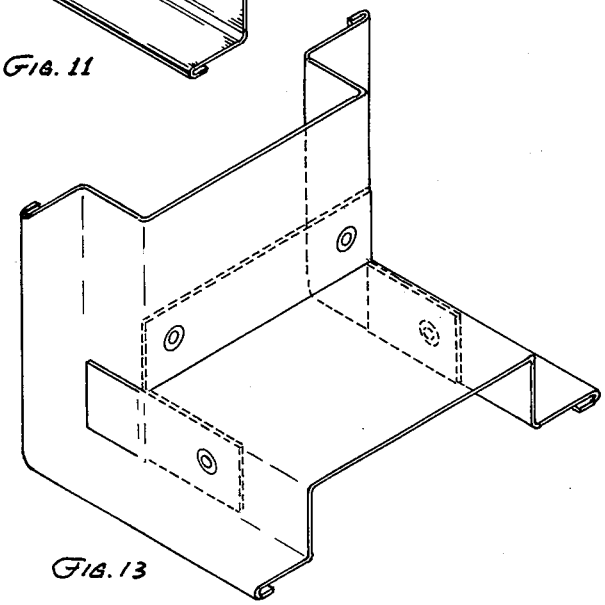
FIG. 13 is a view similar to FIG. 11, but illustrating a corner fabricated from the member of FIGS. 5 and 6.
Figure 17:
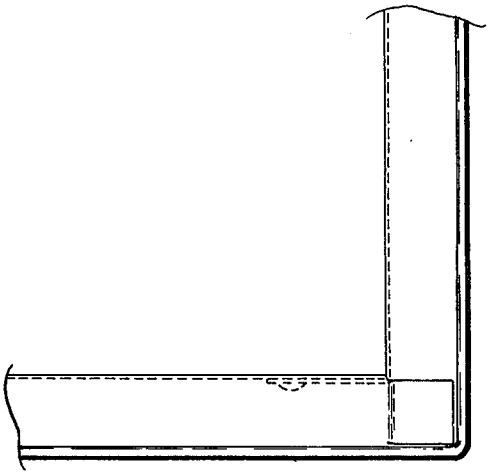
FIG. 17 is a fragmentary, side elevational view of the corner of FIG. 15.
Figure 18:
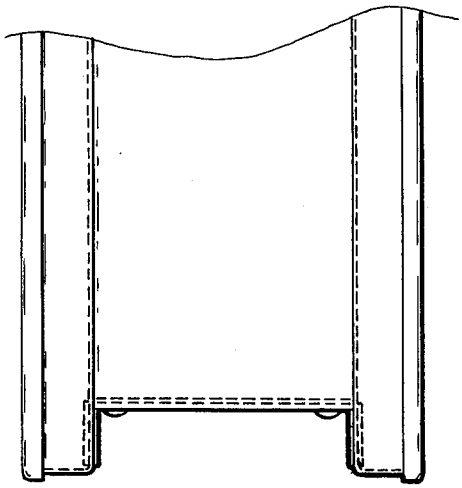
FIG. 18 is a fragmentary, rear elevational view thereof.

When the frame sections are bent at the corners into the right angled configuration illustrated in FIGS. 13 and 14, flap 74 is bent across the corner and riveted or otherwise secured to the bight section material as illustrated in FIG. 14. The flaps 72 are, however, bent (illustrated best in FIG. 13) into parallel embracing relationship to the channel legs and are secured thereto to provide enhanced support for the frame at the corners.

It will, of course, be apparent to those skilled in the art how the corners constructed pursuant to the principles of this invention may be utilized for the manufacture of frames of the type of which the invention is concerned. Obviously, each of the three intermediate corners of a rectangular frame constructed in this manner retains the structural integrity of the unsevered flange portion of the channel member. These unsevered flanges are bent to accommodate the right angle construction and the integrity of the flanges serves to prevent the joints from loosening. The unique, overlapped flap construction in each form of the invention provides reinforcement at the frame corners yet all phases of this construction may be accomplished quickly and easily by high speed punching and bending operations. All forms of the invention utilize the flaps resulting inherently from the nature of the cuts at the corner locations, for securing the terminal ends of the frame member into a unitary frame construction. All forms of the invention may be carried out with the use of identical channel members which can be fabricated by high speed roll forming techniques, and stocked in relatively long lengths for subsequent use to construct frames of whatever sizes may be required.

We claim:

1. A frame for a damper having blade means mounted on the frame for controlling fluid flow through a rectangular damper opening defined by the frames, said frame comprising:

an elongated, initially flat sheet member bent into longitudinally extending, generally inverted U shaped channel having a bight portion and a pair of integral, spaced apart leg portions projecting from the bight portion;

each leg portion having an integral flange projecting outwardly from its corresponding leg portion at an angle thereto;

a slot in the member for each frame corner respectively, each slot extending transversely across the member severing the bight and leg portions thereof, said slots being in dispositions to define the lengths of the longitudinal frame sections;

a pair of spaced apart notches in the bight portion for each frame corner, said notches extending longitudinally of the bight portion and comprising a pair of parallel slits, there being a slit for each edge of the bight portion, each slit extending from the slot in the bight portion and parallel with its bight portion edge adjacent to the latter and communicating with the corresponding slot to define a flap in the bight portion material;

one of said slots extending through said flanges to sever the member at a length suitable for the frame periphery;

the flanges proximal the remaining slots being bent to dispose each adjacent pair of frame sections at substantially right angles to thereby form the frame corners;

the opposed ends of the member being juxtaposed at the corner; and means securing said flaps to the bight portion across the proximal slot to hold the sections in said right angle positions.

2. The invention of claim 1, wherein a portion of the sheet material of the flap at each outermost corner thereof is removed to facilitate bending of the flap into its assembled condition at the frame corner.

3. The invention of claim 1, wherein is provided a cut through the bights portion transversely thereof and spaced longitudinally of the member from the slot in the direction opposite that of the slits to define a transversely extended strip of material between the slot and the cut, and means severing said strip of material intermediate the channel legs to provide a pair of tabs adapted to be bent into abutting alignment with corresponding channel leg portions for attachment to the latter to reinforce the construction of the frame corner.

4. The invention of claim 1 wherein said bight portion material is cut to provide a pair of integral tabs on opposite sides of said transversely extending slot, said tabs being interconnected across the corners to reinforce the latter.

5. The invention of claim 4, wherein are provided tabs integral with the leg portions and projecting from each edge of each slot respectively, the corresponding pairs of slot tabs being secured together after the member is bent at said corner to reinforce the corner.

* * * * *